US010297910B2

(12) United States Patent
Hosadurga et al.

(10) Patent No.: US 10,297,910 B2
(45) Date of Patent: May 21, 2019

(54) HEARING DEVICE WITH BOWTIE ANTENNA OPTIMIZED FOR SPECIFIC BAND

(71) Applicant: Starkey Laboratories, Inc., Eden Prairie, MN (US)

(72) Inventors: Deepak Pai Hosadurga, Bloomington, MN (US); Beau Jay Polinske, Minneapolis, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 214 days.

(21) Appl. No.: 15/331,077

(22) Filed: Oct. 21, 2016

(65) Prior Publication Data

US 2018/0115055 A1 Apr. 26, 2018

(51) Int. Cl.

| | |
|---|---|
| ***H01Q 1/27*** | (2006.01) |
| ***H01Q 1/36*** | (2006.01) |
| ***H01Q 1/22*** | (2006.01) |
| ***H04R 25/00*** | (2006.01) |

(52) U.S. Cl.

CPC ..... *H01Q 1/273* (2013.01); *H01Q 1/2291* (2013.01); *H01Q 1/36* (2013.01); *H04R 25/554* (2013.01); *H04R 2225/51* (2013.01)

(58) Field of Classification Search

CPC ..... H01Q 1/273; H01Q 1/2291; H01Q 1/248

See application file for complete search history.

(56) References Cited

U.S. PATENT DOCUMENTS

| | | | |
|---|---|---|---|
| 3,369,245 | A | 2/1968 | Rea |
| 5,721,783 | A | 2/1998 | Anderson |
| 6,594,370 | B1 | 6/2003 | Anderson |
| 7,289,853 | B1 | 10/2007 | Campbell et al. |
| 7,646,356 | B2 | 1/2010 | Adel et al. |
| 8,605,922 | B2 | 12/2013 | Pulimi et al. |
| 2005/0099341 | A1 | 5/2005 | Zhang et al. |
| 2008/0218293 | A1 | 9/2008 | Liu et al. |

(Continued)

FOREIGN PATENT DOCUMENTS

| | | | |
|---|---|---|---|
| EP | 2458674 | A2 | 5/2012 |
| EP | 1326302 | A2 | 7/2013 |

(Continued)

OTHER PUBLICATIONS

"U.S. Appl. No. 14/706,173, Advisory Action dated Apr. 7, 2017", 3 pgs.

(Continued)

*Primary Examiner* — Daniel Munoz
*Assistant Examiner* — Amal Patel
(74) *Attorney, Agent, or Firm* — Schwegman Lundberg & Woessner, P.A.

(57) ABSTRACT

A hearing device can perform wireless communication with another device using a bowtie antenna. In various embodiments, the bowtie antenna can include two conductive plates and one or more notches in at least one of the two conductive plates. The one or more notches can be sized, shaped, and/or positioned to approximately optimize performance of the bowtie antenna for one or more frequency bands of the wireless communication. In various embodiments, the hearing device can receive energy using the bowtie antenna and charge a rechargeable battery using the received energy.

20 Claims, 6 Drawing Sheets

(56) References Cited

U.S. PATENT DOCUMENTS

| | | | | |
|---|---|---|---|---|
| 2009/0214064 | A1 | 8/2009 | Wu et al. | |
| 2009/0231204 | A1 | 9/2009 | Shaker et al. | |
| 2010/0202639 | A1 | 8/2010 | Christensen et al. | |
| 2012/0002830 | A1 | 1/2012 | Solum | |
| 2012/0087506 | A1 | 4/2012 | Ozden | |
| 2013/0216076 | A1 | 8/2013 | Knudsen et al. | |
| 2013/0241778 | A1 | 9/2013 | Orime et al. | |
| 2013/0342407 | A1 | 12/2013 | Kvist et al. | |
| 2013/0343586 | A1 | 12/2013 | Kvist et al. | |
| 2015/0030190 | A1 | 1/2015 | Rabel et al. | |
| 2015/0042524 | A1* | 2/2015 | Kerselaers | H01Q 1/273 343/718 |
| 2015/0208180 | A1 | 7/2015 | Martius et al. | |
| 2016/0050502 | A1 | 2/2016 | Kvist et al. | |
| 2016/0330552 | A1 | 11/2016 | Flood | |

FOREIGN PATENT DOCUMENTS

| | | | |
|---|---|---|---|
| EP | 2680366 | A1 | 1/2014 |
| EP | 2802037 | A1 | 11/2014 |
| EP | 2835862 | A1 | 2/2015 |
| WO | WO-2005081583 | A1 | 9/2005 |
| WO | WO-2014090420 | A1 | 6/2014 |

OTHER PUBLICATIONS

"U.S. Appl. No. 14/706,173, Final Office Action dated Jan. 12, 2017", 19 pgs.
"U.S. Appl. No. 14/706,173, Non Final Office Action dated Jun. 20, 2016", 14 pgs.
"U.S. Appl. No. 14/706,173, Response filed Mar. 13, 2017 to Final Office Action dated Jan. 12, 2017", 8 pgs.
"U.S. Appl. No. 14/706,173, Response filed Sep. 20, 2016 to Non Final Office Action dated Jun. 20, 2016", 7 pgs.
"European Application Serial No. 16168645.6, Extended European Search Report dated Oct. 7, 2016", 9 pgs.
Mio, Nagatoshi, "Downsized Bow-Tie Antenna with Folded Elements", IEICE Transactions on Electronics, Institute of Electronics, Tokyo, JP, vol. E93C, No. 7, XP001557472, ISSN: 0916-8524, (Jul. 1, 2010), 1098-1104.
Pierce, Richard G., "Broadband Planar Modified Aperture Bowtie Antenna", IEEE Antennas and Wireless Propagation Letters, vol. 12,, (2013), 4 pgs.
"U.S. Appl. No. 14/706,173, Final Office Action dated Feb. 8, 2018", 19 pgs.
"U.S. Appl. No. 14/706,173, Non Final Office Action dated Sep. 18, 2017", 17 pgs.
"U.S. Appl. No. 14/706,173, Response Filed Apr. 9, 2018 to Final Office Action dated Feb. 8, 2018", 8 pgs.
"U.S. Appl. No. 14/706,173, Response filed Dec. 18, 2017 to Non Final Office Action dated Sep. 18, 2017", 10 pgs.
"European Application Serial No. 16168645.6, Response filed Jun. 28, 2017 to Extended European Search Report dated Oct. 7, 2016", 19 pgs.
"European Application Serial No. 17196023.0, Extended European Search Report dated Feb. 26, 2018", 9 pgs.
Angelopoulos, E S, et al., "A modified bow-tie slot antenna fed by a CPW-to-CPW transition loaded with inductively coupled slots for ultra wide-band applications", IEEE International Workshop on Antenna Technology ; IEEE IWAT 2005 ; Marina Mandarin Hotel, Singapore, IEEE Operations Center, Piscataway, NJ (Mar. 7, 2005), 513-516.
Dushyantt, Garg, et al., "Multi band compact bow-tie slot antenna for WLAN applications", Electromagnetic Compatibility (APEMC), Asia-Pacific Symposium on, IEEE, (May 21, 2012), 597-600.
Huang, C Y, et al., "Multiple band-stop bow-tie slot antennas for multi band wireless systems", IET Microwaves Antennas & Propaga, vol. 2, No. 6, (Sep. 8, 2008), 588-593.
Mathew, Jibish, et al., "A modified bow-tie antenna for dual band RFID applications", IEEE 9th International Conference on Intelligent Systems and Control (ISCO), (Jan. 9, 2015), 1-3.
Yu-Wei, Liu, et al., "Metal strip-embedded slot bowtie antenna for Wi-Fi and WiMAX applications", Antennas and Propagation Society International Symposium (APSURSI), 2010 IEEE, IEEE, Piscataway, NJ, USA, (Jul. 11, 2010), 1-4.
"U.S. Appl. No. 14/706,173, Advisory Action dated May 22, 2018", 4 pgs.
"U.S. Appl. No. 14/706,173, Non Final Office Action dated Oct. 9, 2018", 21 pgs.
U.S. Appl. No. 14/706,173, filed May 7, 2015, Hearing Aid Bowtie Antenna Optimized for Ear to Ear Communications.

* cited by examiner

HEARING DEVICE WITH BOWTIE ANTENNA OPTIMIZED FOR SPECIFIC BAND

TECHNICAL FIELD

This document relates generally to hearing systems and more particularly to a hearing device with a bowtie antenna.

BACKGROUND

Hearing devices provide sound for the wearer. Some examples of hearing devices are headsets, hearing aids, speakers, cochlear implants, bone conduction devices, and personal listening devices. Hearing devices may be capable of performing wireless communication between each other and/or other devices. For example, hearing aids provide amplification to compensate for hearing loss by transmitting amplified sounds to their ear canals. The sounds may be detected from the wearer's environment using the microphone in a hearing aid and/or received from a streaming device via a wireless link. Wireless communication may also be performed for programming the hearing aid and receiving information from the hearing aid. For performing such wireless communication, hearing devices such as hearing aids may each include a wireless transceiver and an antenna.

SUMMARY

A hearing device can perform wireless communication with another device using a bowtie antenna. In various embodiments, the bowtie antenna can include two conductive plates and one or more notches in at least one of the two conductive plates. The one or more notches can be sized, shaped, and/or positioned to approximately optimize performance of the bowtie antenna for one or more frequency bands of the wireless communication. In various embodiments, the hearing device can receive energy using the bowtie antenna and charge a rechargeable battery using the received energy.

In an exemplary embodiment, a hearing device include an electronic circuit and a shell housing at least portions of the electronic circuit. The electronic circuit can receive one or more input signals, produce an output sound using the received one or more input signals, and transmit the output sound to the wearer. The electronic circuit can include a bowtie antenna and a communication circuit. The bowtie antenna can include a first conductive plate, a second conductive plate, one or more notches in at least one of the first conductive plate and the second conductive plate, and an antenna feed connected to the first conductive plate and the second conductive plate. The one or more notches can be configured to approximately optimize performance of wireless communication for one or more specified frequency bands. The communication circuit can perform the wireless communication using the bowtie antenna In an exemplary embodiment, a hearing device include an electronic circuit and a shell housing at least portions of the electronic circuit. The electronic circuit can receive one or more input signals, produce an output sound using the received one or more input signals, and transmit the output sound to the wearer. The electronic circuit can include a bowtie antenna, a communication circuit, a rechargeable battery, and a power circuit. The bowtie antenna include a first conductive plate, a second conductive plate, and an antenna feed connected to the first conductive plate and the second conductive plate. The communication circuit can perform wireless communication using the bowtie antenna. The power circuit can receive energy using the bowtie antenna and charge the rechargeable battery using the received energy.

In an exemplary embodiment, a method for operating a hearing device is provided. The method can include receiving one or more input signals, processing the received one or more input signals to produce one or more output signals using a processing circuit of the hearing device, and producing an output sound using a first output signal using a receiver of the hearing device. A first input signal of the one or more input signals can be received via wireless communication using a communication circuit of the hearing device coupled to a bowtie antenna of the hearing device. The bowtie antenna can include a first conductive plate, a second conductive plate, and one or more notches in at least one of the first conductive plate and the second conductive plate, the one or more notches configured to approximately optimize a parameter for one or more specified frequency bands of the wireless communication. The parameter is associated with performance of the wireless communication.

This summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
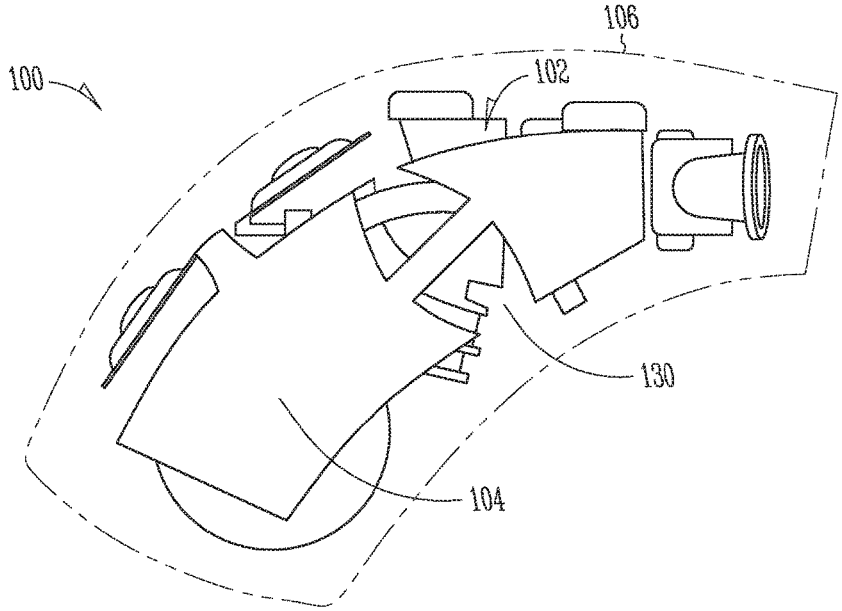
FIG. 1 is an illustration of an exemplary embodiment of portions of a hearing aid including a bowtie antenna.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

This document discusses, among other things, a hearing device including a bowtie antenna optimized for wireless communication. In various embodiments, the bowtie antenna can allow for ear-to-ear communication with another hearing device worn by the same wearer and/or communication with another device capable of communication with the hearing device, such as a programming device, a cellphone, an audio streaming device, a device configured to send one or more types of notification to the wearer, and a device configured to allow the wearer to use the hearing device as a remote controller. In various embodiments, the hearing device is powered by a rechargeable battery and can include a battery charging circuit that receives energy using the bowtie antenna.

A bowtie antenna (also spelled as "bow-tie antenna" or "bow tie antenna") can include two conductive objects and be fed at a gap between the two conductive objects. Each conductive object can be formed by one or more conductive (e.g., metal) wires or plates. Examples of the bowtie antenna as used in hearing aids are discussed in U.S. patent application Ser. No. 14/706,173, entitled "HEARING AID BOWTIE ANTENNA OPTIMIZED FOR EAR TO EAR COMMUNICATIONS", filed on May 7, 2015, assigned to Starkey Laboratories, Inc., which is incorporated herein by reference in its entirety. Bowtie antennas are generally known as dipole broadband antennas, and can be referred to as "butterfly" antennas or "biconical" antennas.

Performance of an antenna in wireless communication, such as its radiation efficiency, depends on impedance matching between the feed point of the antenna and the output of the communication circuit such as a transceiver. The impedance of the antenna is a function of the operating frequency of the wireless communication. When used in a hearing device that is to be worn on a wearer's head, such as in a hearing aid to be worn in or about an ear of the wearer, the impedance of the antenna can be substantially affected by the presence of human tissue. Such effect is known as head loading and can make the performance of the antenna when the hearing device is worn (referred to as "on head performance") substantially different from the performance of the antenna when the hearing device is not worn. Impedance of the antenna including effect of head loading depends on configuration and placement of the antenna, which are constrained by size and placement of other components of the hearing device. When a pair of binaural hearing devices are worn by the wearer, asymmetric antenna performances of the hearing devices worn on the right and left side of the wearer's head may result from placement of components in these hearing devices. Such factors contribute to difficulty in impedance matching and hence limit realized gain of the antenna.

A hearing device such as a hearing aid can be powered by a rechargeable battery. The rechargeable battery can be wirelessly recharged using a recharging device magnetically or electromagnetically coupled to a battery charging circuit in the hearing device, eliminating the need for removing battery from the hearing device for recharging. An antenna is needed to receive the energy magnetically or electromagnetically transmitted to the hearing aid. Separate antennas can be used for the wireless communication and battery charging, but using an additional antenna in a hearing device such as hearing aid may be undesirable.

The present subject matter provides for optimization of the bowtie antenna for specific frequency bands by introducing one or more notches to modify aperture of the antenna. In various embodiments, the one or more notches can be sized, shaped, and placed on the conductive plates of the bowtie antenna based on placement of other components in the hearing device and on head performance of the wireless communication using the antenna. For example, shape, size and placement of each notch can initially be selected based on available space in the hearing device, and then manipulated to achieve the desired performance of the wireless communication. When notches are placed in both conductive plates of the bowtie antenna, the placement can be symmetric or asymmetric, depending on specific hearing device configuration and available space as determined by the placement of other components. In various embodiments, the aperture of the antenna can be modified by the notches to broaden impedance bandwidth for better impedance matching. The broadened impedance bandwidth may also reduce the antenna performance asymmetry when a pair of binaural hearing devices are worn by the wearer. An experiment showed that introduction of notches to a bowtie antenna improved antenna performance of a hearing aid by reducing the resonance at 4.8 GHz (harmonic) and improving the resonance at 2.4 GHz (operation frequency), and the notched bowtie antenna provided a broader impedance bandwidth that resulted in a better realized antenna gain. In various embodiments, notches can be made in a different manner depending upon design considerations specific to each hearing device. In various embodiments, the antenna performance can be further improved by increasing or approximately maximizing physical aperture of the bowtie antenna within the design constraints of the hearing device. In some embodiments, the bowtie antenna can be used for both wireless communication and battery charging. The bowtie antenna can be optimized (e.g., notched) for a dual-band application, with a first frequency band for the wireless communication and a substantially different second frequency band for the battery charging. The bowtie antenna can be dual fed or can be controllably connected to one of the communication and battery charging circuits using a switch. The antenna can be tuned for battery charging in free space when the rechargeable battery is to be charged while the hearing device is not being worn.

While application in a hearing aid is specifically discussed as an example, the present subject matter can be applied in any hearing device capable of wireless communication using a bowtie antenna. In various embodiments, the bowtie antenna can be sized, shaped, and placed in the hearing device, such as contained within or incorporated into a housing of the hearing device.

FIG. 1 is an illustration of an exemplary embodiment of portions of a hearing aid 100 including a bowtie antenna 104. Hearing aid 100 includes a hearing aid circuit 102, which is an electronic circuit that can receive one or more input signals and produce an output sound using the received one or more input signals. Portions of the electronic circuit, which include a plurality of circuit components, can be housed in a shell 106. In the illustrated embodiment, shell 106 allows hearing aid 100 to reside substantially behind or over an ear of a wearer when being worn by the wearer. Shell 106 is configured for use in a behind-the-ear (BTE) type hearing aid, a receiver-in-canal (RIC) type hearing aid, or a receiver-in-the-ear (RITE) type hearing aid. In various embodiments, shell 106 can be configured for use in any type of hearing device, including any type of hearing aid, in which a bowtie antenna is suitable for placement and use for wireless communication.

Hearing aid circuit 102 can perform wireless communication using bowtie antenna 104. In various embodiments, bowtie antenna 104 can include one or more notches 130 in its conductive structure to approximately optimize performance of the wireless communication for one or more specified frequency bands. In some embodiments, hearing aid 100 can include a rechargeable battery. Hearing aid circuit 102 can receive energy using bowtie antenna 104, and can charge the rechargeable battery using the received energy.

Figure 2:
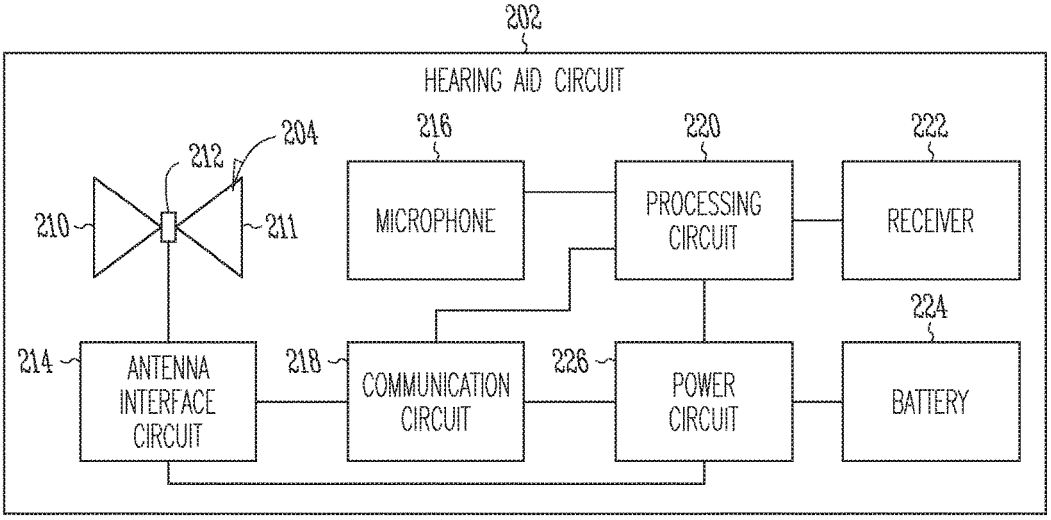
FIG. 2 is a block diagram illustrating an exemplary embodiment of portions of a circuit of a hearing aid, such as the hearing aid of FIG. 1.

FIG. 2 is a block diagram illustrating an exemplary embodiment of portions of a hearing aid circuit 202, which can be an example of hearing aid circuit 102. Hearing aid circuit 202 can represent an example of portions of a circuit of hearing aid 100, and can include a microphone 216, a communication circuit 218, a bowtie antenna 204, an antenna interface circuit 214, a processing circuit 220, a receiver (speaker) 222, a battery 224, and a power circuit 226. Microphone 216 can receive sounds from the environment of the wearer of hearing aid 100. Communication circuit 218 can communicate with another device wirelessly using bowtie antenna 204, including receiving programming codes, streamed audio signals, and/or other audio signals and transmitting programming codes, audio signals, and/or other signals. Examples of the other device can include the other hearing aid of a pair of hearing aids for the same wearer, a hearing aid host device, an audio streaming device, a telephone, and other devices capable of communicating with hearing aids wirelessly. Antenna interface circuit 214 provides an interface, such as impedance matching, between bowtie antenna 204 and communication circuit 218 and between bowtie antenna 204 and power circuit 226. Processing circuit 220 can control the operation of hearing aid 100 using the programming codes and processes the sounds received by microphone 216 and/or the audio signals received by communication circuit 218 to produce output signals. Receiver 222 can generate output sounds using the output signals and transmit the output sounds to an ear canal of the wearer. Battery 224 and power circuit 226 constitute the power source for the operation of hearing aid circuit 202. In some embodiments, power circuit 226 can include a power management circuit. In some embodiments, battery 224 can include a rechargeable battery, and power circuit 226 can include a battery charging circuit that can receive energy transmitted to hearing aid 100 using antenna 204 and charge the rechargeable battery using the received energy.

Bowtie 204 can include a first conductive plate 210, a second conductive plate 211, and an antenna feed (as referred to as feed point) 212 connected to first conductive plate 210 and second conductive plate 211. In various embodiment, first conductive plate 210 and second conductive plate 211 can each include a conductive sheet (rather than one or more wires). Bowtie antenna 104 can represent an example of bowtie antenna 204 as configured and placed in a hearing aid.

Figure 3:
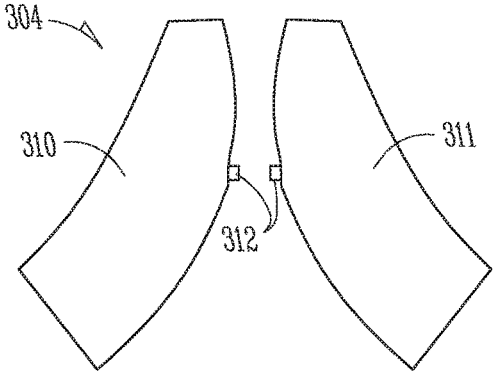
FIG. 3 is an illustration of an exemplary embodiment of a bowtie antenna for use in a hearing aid, such as the hearing aid of FIG. 1.

FIG. 3 is an illustration of an exemplary embodiment of a bowtie antenna 304 for use in a hearing aid, such as hearing aid 100. Bowtie antenna 304 can represent an example of bowtie antenna 204 and includes a first conductive plate 310, a second conductive plate 311, and an antenna feed 312 connected to first conductive plate 310 and second conductive plate 311. In the illustrated embodiment, first conductive plate 310 and second conductive plate 311 are substantially symmetric. In various embodiments, first conductive plate 310 and second conductive plate 311 can be substantially symmetric or substantially asymmetric.

FIG. 3 illustrates bowtie antenna 304 including first conductive plate 310 and second conductive plate 311 in their flattened state. In various embodiments when bowtie antenna 304 is placed in hearing aid 100, first conductive plate 310 and second conductive plate 311 can be shaped and bent to be positioned within shell 106. In various other embodiments, first conductive plate 310 and second conductive plate 311 can be incorporated into shell 106.

FIGS. 4A-4F are each an illustration of an exemplary embodiment of the bowtie antenna of FIG. 3 modified to include notches. FIGS. 4A-4F each illustrate a bowtie antenna 404 (404A, 404B, 404C, 404D, 404 E, or 404F in FIGS. 4A-4F, respectively) including its two conductive plates 410-411 (410A-411A, 410B-411B, 410C-411C, 410D-411D, 410E-411E, or 410F-411F in FIGS. 4A-4F, respectively) shown in their flattened state. Bowtie antenna 404 can represent examples of bowtie antenna 204, and includes antenna feed 312. In the illustrated embodiments, conductive plates 410 and 411 each include a plurality of notches 430 (430A, 430B, 430C, 430D, 430 E, or 430F in FIGS. 4A-4F, respectively). In various embodiments, at least one of conductive plates 410 and 411 includes one or more notches 430. In various embodiments, the one or more notches can be configured (e.g., sized, shaped, and positioned in conductive plates 410 and/or 411) based on placement of the plurality of circuit components of hearing aid circuit 102 in shell 106. In various embodiments, the one or more notches can be configured (e.g., sized, shaped, and positioned in conductive plates 410 and/or 411) to approximately optimize performance of the bowtie antenna for one or more specified frequency bands. An example of the one or more specified frequency bands includes the 2.4 GHz Industrial Scientific Medical (ISM) radio band (e.g., with a frequency range of 2.4 GHz-2.5 GHz and a center frequency of 2.45 GHz).

In various embodiments, bowtie antenna 404 can be formed by introducing the one or more notches to bowtie antenna 304. The introduction of the one or more notches modify the aperture of bowtie antenna 304, such that bowtie antenna 404 has an aperture that is substantially different from that of bowtie antenna 304. The one or more notches can each have an approximately triangular, rectangular, circular, or irregular shape, depending on design considerations such as the placement of the circuit components of hearing aid circuit 102 and/or ease of modifying size of each notch for the optimization. In various embodiments, the one or more notches can be configured (e.g., sized, shaped, and positioned in conductive plates 410 and/or 411) to approximately maximize a radiation efficiency of bowtie antenna 404. In various embodiments, the one or more notches can be configured (e.g., sized, shaped, and positioned in conductive plates 410 and/or 411) to approximately optimize the impedance bandwidth of bowtie antenna 404. In various embodiments, the one or more notches can be configured (e.g., sized, shaped, and positioned in conductive plates 410 and/or 411) to provide bowtie antenna 404 with a specified impedance bandwidth. In various embodiments, the one or more notches can be configured (e.g., sized, shaped, and positioned in conductive plates 410 and/or 411) to approximately to maximize the impedance bandwidth of bowtie antenna 404.

Figure 4A:
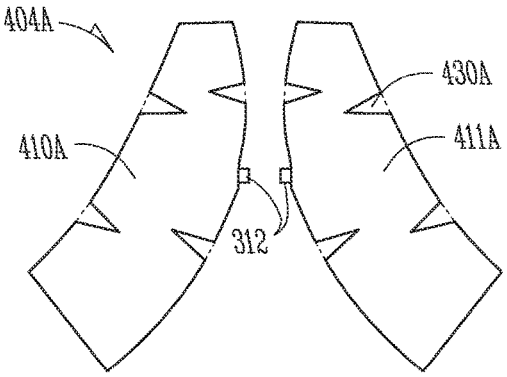
FIGS. 4A-4F are each an illustration of an exemplary embodiment of the bowtie antenna of FIG. 3 modified to include notches.
Figure 4B:
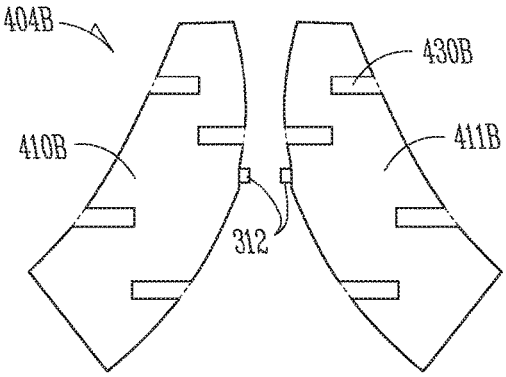
Figure 4C:
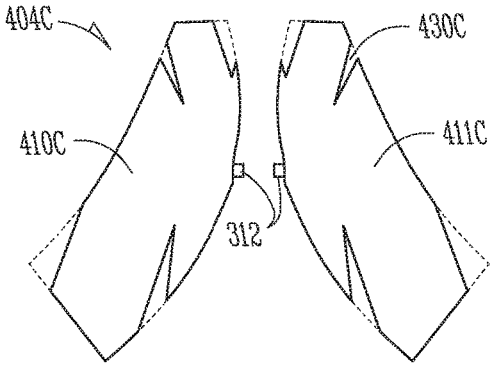
Figure 4D:
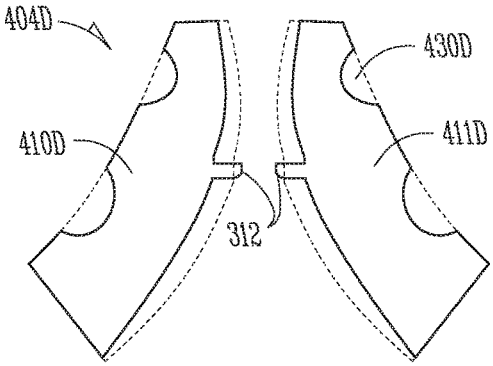
Figure 4E:
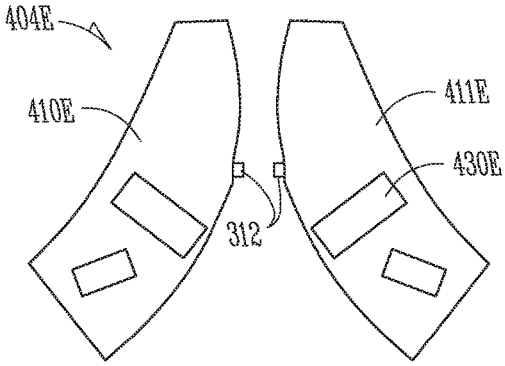
Figure 4F:
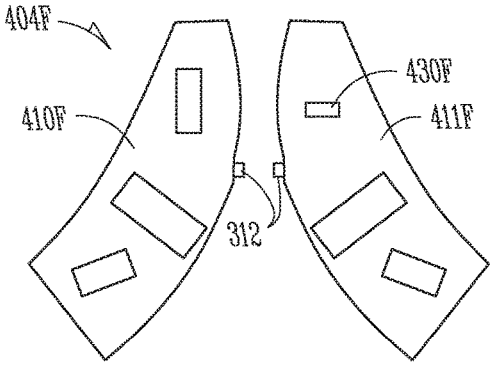

In various embodiments, each of conductive plates 410 and 411 includes one or more notches 430. In various embodiments, the one or more notches in conductive plate 410 and the one or more notches in conductive plate 411 are substantially symmetric, such as illustrated in FIGS. 4A-4E. In various embodiments, the one or more notches in conductive plate 410 and the one or more notches in conductive plate 411 are substantially asymmetric, such as illustrated in FIG. 4F.

Figure 5:
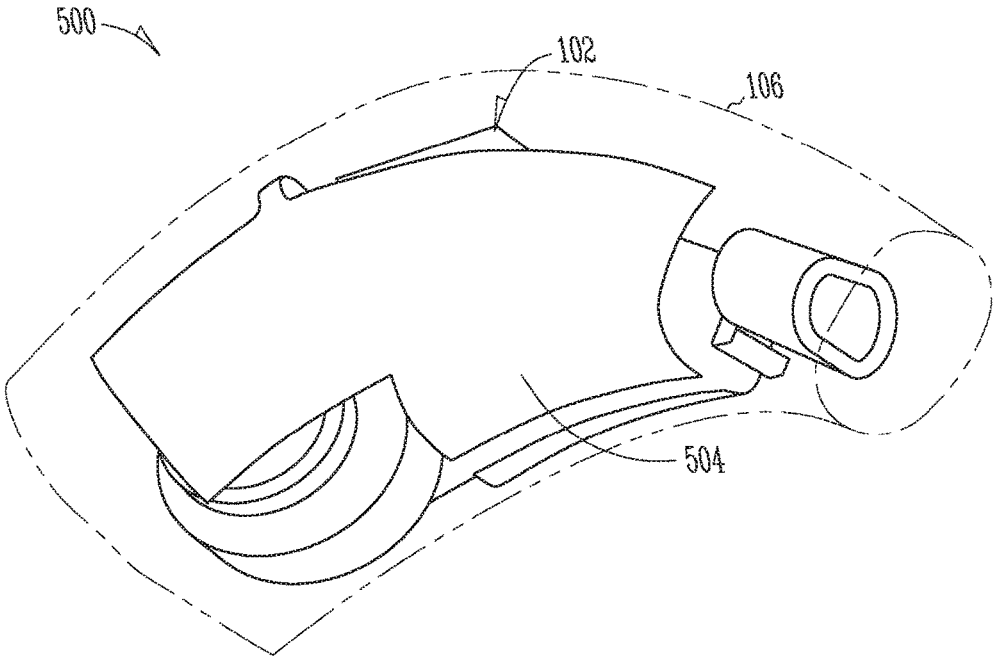
FIG. 5 is an illustration of an exemplary embodiment of portions of a hearing aid including a bowtie antenna having an approximately maximized size.

FIG. 5 is an illustration of an exemplary embodiment of portions of a hearing aid 500 including a bowtie antenna 504 having an approximately maximized size. Hearing aid 500 can represent an example of hearing aid 100. Bowtie antenna 504 can represent an example of bowtie antenna 204. In various embodiments, the conductive plates of bowtie antenna 504 can be approximately maximized to approximately maximize the aperture of antenna 504, thereby improving efficiency of the antenna. In various embodiments, one or more notches such as notches 430 can be introduced to bowtie antenna 504 to approximately optimize performance of bowtie antenna 504 in manners discussed above for bowtie antenna 404.

Figure 6:
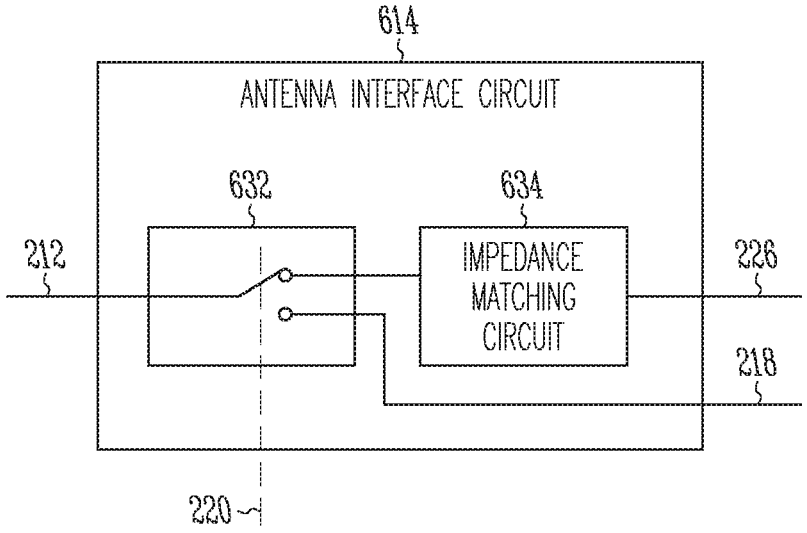
FIG. 6 is a block diagram illustrating an exemplary embodiment of an antenna interface circuit of the hearing device.

FIG. 6 is a block diagram illustrating an exemplary embodiment of an antenna interface circuit 614, which can represent an example of antenna interface circuit 214. Antenna interface circuit 614 includes a switch 632 and an impedance matching circuit 634. Switch 632 provides a first connection between antenna feed 212 and power circuit 226 through impedance matching circuit 634 during battery charging periods and a second connection between antenna feed 212 and communication circuit 218 during communication periods. Processing circuit 220 controls timing of the wireless communication and battery charging, and generates timing control signals for the communication periods and battery charging periods.

Figure 7:
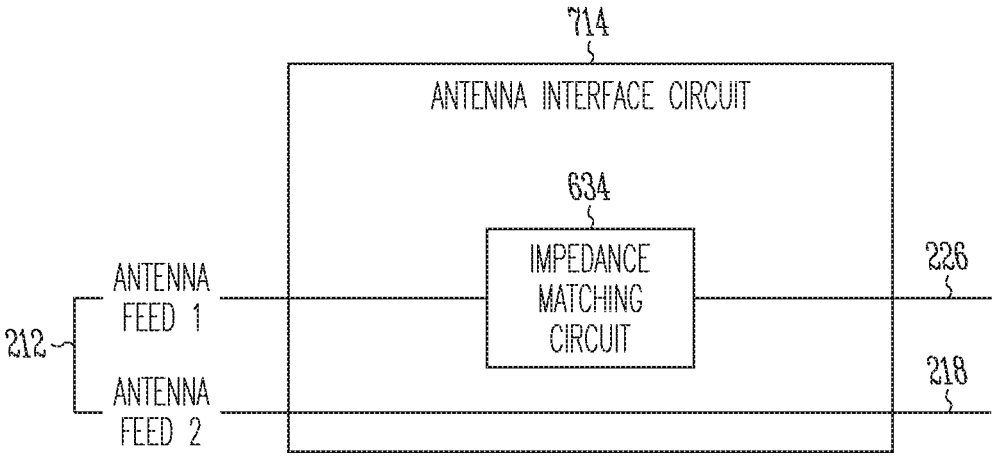
FIG. 7 is a block diagram illustrating another exemplary embodiment of the antenna interface circuit.

FIG. 7 is a block diagram illustrating an exemplary embodiment of an antenna interface circuit 714, which can represent another example of antenna interface circuit 214. Antenna interface circuit 714 can provide a connection between bowtie antenna 204 and communication circuit 218 and another connection between bowtie antenna 204 and power circuit 226 when antenna feed 212 includes separate antenna feeds for the wireless communication and the battery charging. Antenna interface circuit 714 includes impedance matching circuit 634 connected between the antenna feed for the battery charging (ANTENNA FEED 1) and power circuit 226, and provides a connection between the antenna feed for the wireless communication (ANTENNA FEED 2) and communication circuit 218.

Figure 8:
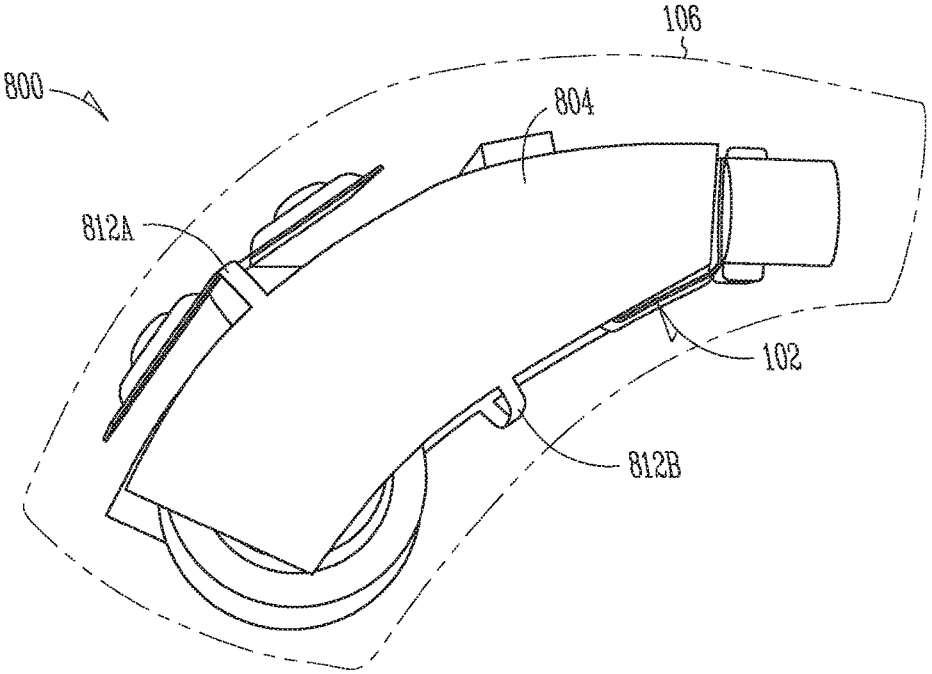
FIG. 8 is an illustration of an exemplary embodiment of portions of a hearing aid including a bowtie antenna with dual feeds for wireless communication and battery charging.

FIG. 8 is an illustration of an exemplary embodiment of portions of a hearing aid 800. Hearing aid 800 can represent an example of hearing aid 100 and can include a bowtie antenna 804 with dual antenna feeds 812A and 812B for the wireless communication and the battery charging. Antenna feeds 812A and 812B are examples of the ANTENNA FEED 1 and ANTENNA FEED 2 shown in FIG. 7. In various embodiments, except for antenna feeds 812A and 812B, bowtie antenna 804 can be substantially identical to bowtie antenna 304, 404, or 504. In other words, bowtie antenna 804 can include conductive plates 310-311 or 410-411, with the one or more notches as discussed above with reference to FIG. 4, and/or with approximately maximized aperture as discussed above with reference to FIG. 5.

Figure 9:
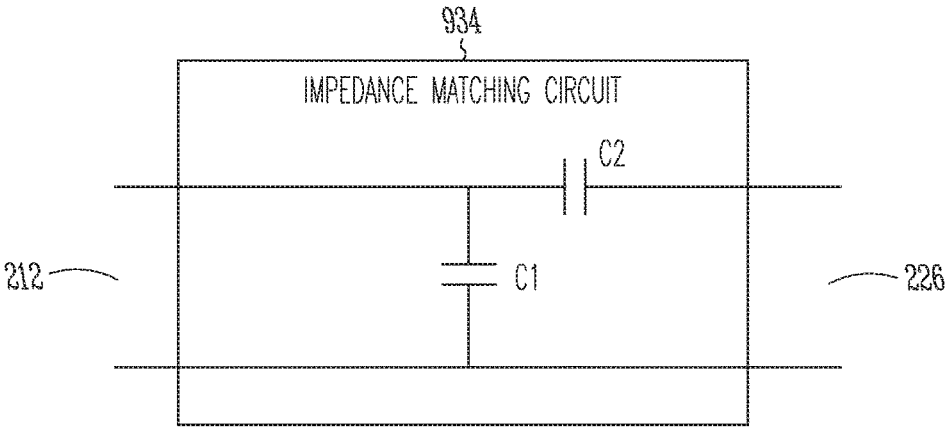
FIG. 9 is a circuit schematic illustrating an exemplary embodiment of an impedance matching circuit of the antenna interface circuit.

FIG. 9 is a circuit schematic illustrating an exemplary embodiment of an impedance matching circuit 934. Impedance matching circuit 934 can represent an example of impedance matching circuit 634 and include capacitors C1 and C2. In various embodiments, impedance matching circuit 934 can function as an impedance matching network between the input impedance of power circuit 226 and the impedance of bowtie antenna 204. In various embodiments, the one or more notches 430 are configured to approximately optimize the impedance of bowtie antenna 204 such that the impedance matching between power circuit 226 and bowtie antenna 204 is approximately optimized. For example, the one or more notches 430 are configured to approximately maximize the impedance bandwidth of bowtie antenna 204 such that the impedance matching is less sensitive to variations in the frequency of the wireless communication during operation of hearing aid 100.

Hearing devices typically include at least one enclosure or housing, a microphone, hearing device electronics including processing electronics, and a speaker or "receiver." Hearing devices may include a power source, such as a battery. In various embodiments, the battery may be rechargeable. In various embodiments, multiple energy sources may be employed. It is understood that in various embodiments the microphone is optional. It is understood that in various embodiments the receiver is optional. It is understood that variations in communications protocols, antenna configurations, and combinations of components may be employed without departing from the scope of the present subject matter. Antenna configurations may vary and may be included within an enclosure for the electronics or be external to an enclosure for the electronics. Thus, the examples set forth herein are intended to be demonstrative and not a limiting or exhaustive depiction of variations.

It is understood that digital hearing aids include a processor. In digital hearing aids with a processor, programmable gains may be employed to adjust the hearing aid output to a wearer's particular hearing impairment. The processor may be a digital signal processor (DSP), microprocessor, microcontroller, other digital logic, or combinations thereof. The processing may be done by a single processor, or may be distributed over different devices. The processing of signals referenced in this application can be performed using the processor or over different devices. Processing may be done in the digital domain, the analog domain, or combinations thereof. Processing may be done using subband processing techniques. Processing may be done using frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, buffering, and certain types of filtering and processing. In various embodiments the processor is adapted to perform instructions stored in one or more memories, which may or may not be explicitly shown. Various types of memory may be used, including volatile and nonvolatile forms of memory. In various embodiments, the processor or other processing devices execute instructions to perform a number of signal processing tasks. Such embodiments may include analog components in communication with the processor to perform signal processing tasks, such as sound reception by a microphone, or playing of sound using a receiver (i.e., in applications where such transducers are used). In various embodiments, different realizations of the block diagrams, circuits, and processes set forth herein can be created by one of skill in the art without departing from the scope of the present subject matter.

Various embodiments of the present subject matter support wireless communications with a hearing device. In various embodiments the wireless communications can include standard or nonstandard communications. Some examples of standard wireless communications include, but not limited to, Bluetooth™, low energy Bluetooth, IEEE 802.11 (wireless LANs), 802.15 (WPANs), and 802.16 (WiMAX). Cellular communications may include, but not limited to, CDMA, GSM, ZigBee, and ultra-wideband (UWB) technologies. In various embodiments, the communications are radio frequency communications. In various embodiments the communications are optical communications, such as infrared communications. In various embodiments, the communications are inductive communications. In various embodiments, the communications are ultrasound communications. Although embodiments of the present system may be demonstrated as radio communication systems, it is possible that other forms of wireless communications can be used. It is understood that past and present standards can be used. It is also contemplated that future versions of these standards and new future standards may be employed without departing from the scope of the present subject matter.

The wireless communications support a connection from other devices. Such connections include, but are not limited to, one or more mono or stereo connections or digital connections having link protocols including, but not limited to 802.3 (Ethernet), 802.4, 802.5, USB, ATM, Fibre-channel, Firewire or 1394, InfiniBand, or a native streaming interface. In various embodiments, such connections include all past and present link protocols. It is also contemplated that future versions of these protocols and new protocols may be employed without departing from the scope of the present subject matter.

In various embodiments, the present subject matter is used in hearing devices that are configured to communicate with mobile phones. In such embodiments, the hearing device may be operable to perform one or more of the following: answer incoming calls, hang up on calls, and/or provide two way telephone communications. In various embodiments, the present subject matter is used in hearing devices configured to communicate with packet-based devices. In various embodiments, the present subject matter includes hearing devices configured to communicate with streaming audio devices. In various embodiments, the present subject matter includes hearing devices configured to communicate with Wi-Fi devices. In various embodiments, the present subject matter includes hearing devices capable of being controlled by remote control devices.

It is further understood that different hearing devices may embody the present subject matter without departing from the scope of the present disclosure. The devices depicted in the figures are intended to demonstrate the subject matter, but not necessarily in a limited, exhaustive, or exclusive sense. It is also understood that the present subject matter can be used with a device designed for use in the right ear or the left ear or both ears of the wearer.

The present subject matter may be employed in hearing devices, such as hearing aids, headsets, headphones, and similar hearing devices.

The present subject matter may be employed in hearing devices having additional sensors. Such sensors include, but are not limited to, magnetic field sensors, telecoils, temperature sensors, accelerometers and proximity sensors.

The present subject matter is demonstrated for hearing devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices. The present subject matter can also be used in deep insertion devices having a transducer, such as a receiver or microphone. The present subject matter can be used in devices whether such devices are standard or custom fit and whether they provide an open or an occlusive design. It is understood that other hearing devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing device configured to be worn by a wearer, comprising:

an electronic circuit configured to receive one or more input signals, produce an output sound using the received one or more input signals, and transmit the output sound to the wearer, the electronic circuit including:

a bowtie antenna including a first conductive plate, a second conductive plate, one or more notches in at least one of the first conductive plate and the second conductive plate, and an antenna feed connected to the first conductive plate and the second conductive plate, the one or more notches configured to approximately optimize performance of wireless communication for one or more specified frequency bands;

a communication circuit coupled to the antenna feed, the communication circuit configured to perform the wireless communication using the bowtie antenna;

a rechargeable battery; and a power circuit coupled to the antenna feed, the power circuit configured to receive energy using the bowtie antenna and to charge the rechargeable battery using the received energy; and a shell housing at least portions of the electronic circuit.

2. The hearing device of claim 1, wherein the hearing device comprises a hearing aid, and the shell is configured to allow the hearing device to reside substantially behind or over an ear of the wearer when being worn by the wearer.

3. The hearing device of claim 2, wherein the first conductive plate and the second conductive plate are each shaped and bent to be positioned within the shell.

4. The hearing device of claim 3, wherein the electronic circuit comprises a plurality of circuit components, and the one or more notches are sized, shaped, and positioned to accommodate placement of the plurality of circuit components in the shell.

5. The hearing device of claim 4, wherein the one or more notches comprise one or more first notches in the first conductive plate and one or more second notches in the second conductive plate, and the one or more first notches and the one or more second notches are substantially asymmetric.

6. The hearing device of claim 4, wherein the one or more notches are configured to approximately maximize a radiation efficiency of the bowtie antenna.

7. The hearing device of claim 4, wherein the one or more notches are configured to approximately optimize an impedance bandwidth of the bowtie antenna.

8. The hearing device of claim 1, wherein the electronic circuit further comprises:

a switch configured to provide a first connection between the antenna feed and the communication circuit during communication periods and a second connection between the antenna feed and the power circuit during battery charging periods; and a processing circuit configured to control the communication periods and the battery charging periods.

9. A hearing device configured to be worn by a wearer, comprising:

an electronic circuit configured to receive one or more input signals, produce an output sound using the received one or more input signals, and transmit the output sound to the wearer, the electronic circuit including:

a bowie antenna including a first conductive plate, a second conductive plate, and an antenna feed connected to the first conductive plate and the second conductive plate;

a communication circuit coupled to the antenna feed, the communication circuit configured to perform wireless communication using the bowtie antenna;

a rechargeable battery; and a power circuit coupled to the antenna feed, the power circuit configured to receive energy using the bowtie antenna and charge the rechargeable battery using the received energy; and a shell housing at least portions of the electronic circuit.

10. The hearing device of claim 9, wherein the antenna feed comprises a first antenna feed coupled to the communication circuit and a second an antenna feed coupled to the battery charging circuit.

11. The hearing device of claim 9, wherein the electronic circuit further comprises:

a switch coupled to the antenna feed, the switch configured to provide a first connection between the antenna feed and the communication circuit during communication periods and a second connection between the antenna feed and the power circuit during battery charging periods; and a processing circuit configured to control the communication periods and the battery charging periods.

12. The hearing device of claim 9, wherein the bowtie antenna comprises one or more notches in at least one of the first conductive plate and the second conductive plate, the one or more notches sized, shaped, and positioned to approximately optimize radiation efficiency of the bowtie antenna for one or more specified frequency bands.

13. The hearing device of claim 12, wherein the hearing device comprises a hearing aid, the shell is configured to allow the hearing device to reside substantially behind or over an ear of the wearer when being worn by the wearer, and the first conductive plate and the second conductive plate are each shaped and bent to be positioned within the shell.

14. The hearing device of claim 13, wherein the one or more notches comprise one or more first notches in the first conductive plate and one or more second notches in the second conductive plate, the one or more first notches and the one or more second notches being substantially asymmetric.

15. A method for operating a hearing device, the method comprising:

receiving one or more input signals, including receiving a first input signal of the one or more input signals via wireless communication using a communication circuit of the hearing device coupled to a bowtie antenna of the heating device, the bowtie antenna including a first conductive plate, a second conductive plate, and one or more notches in at least one of the first conductive plate and the second conductive plate, the one or more notches configured to approximately optimize a parameter for one or more specified frequency bands of the wireless communication, the parameter associated with performance of the wireless communication;

processing the received one or more input signals to produce one or more output signals using a processing circuit of the hearing device;

producing an output sound using a first output signal of the one or more output signal using a receiver of the hearing device;

receiving energy wirelessly transmitted to the hearing device using a power circuit of the hearing device coupled to the bowtie antenna; and charging a rechargeable battery of the hearing device using the received energy.

16. The method of claim 15, further comprising transmitting a second output signal of the one or more output signal to another device via the wireless communication using the communication circuit and the bowtie antenna.

17. The method of claim 16, comprising receiving the first input signal and transmitting the second output signal via the wireless communication using the communication circuit coupled to the bowtie antenna with the one or more notches sized, shaped, and positioned in at least one of the first conductive plate and the second conductive plate to approximately optimize the impedance bandwidth of the bowtie antenna for impedance matching.

18. The method of claim 17, comprising receiving the first input signal and transmitting the second output signal via the wireless communication using the communication circuit coupled to the bowtie antenna with one or more first notches of the one or more notches positioned in the first conductive plate and one or more second notches of the one or more notches positioned in the second conductive plate, the one or more first notches and the one or more second notches positioned in an asymmetric manner.

19. The method of claim 18, comprising receiving the one or more input signals and processing the received one or more input signals to produce one or more output signals using portions of an electronic circuit housed in a shell configured to allow the hearing device to reside substantially behind or over an ear of a wearer when being worn by the wearer, the portions of the electronic circuit including the communication circuit, the bowtie antenna, and the processor.

20. The method of claim 15, wherein receiving the first signal comprises receiving the first signal during communication periods, and receiving the energy comprising receiving the energy during charging periods, and further comprising controlling the communication periods and the battery charging periods using the processing circuit.

* * * * *